United States Patent [19]

Bieramperl

[11] 4,245,334

[45] Jan. 13, 1981

[54] DEVICE FOR MEASURING AND INDICATING THE TIME BETWEEN THE RECEPTION OF FIRST AND SECOND AIRBORNE SIGNALS

[76] Inventor: Erich Bieramperl, In der Stockwiesen 3, A-4020 Linz, Austria

[21] Appl. No.: 53,404

[22] Filed: Jun. 29, 1979

[51] Int. Cl.[3] ..... G04F 8/00

[52] U.S. Cl. ..... 368/2; 368/3; 368/6

[58] Field of Search ..... 58/145 A, 145 D, 145 R, 58/152 E, 152 F, 74, 75, 23 R, 39.5; 364/565, 569; 324/181; 235/92 GA, 92 T; 368/2, 3, 6, 8, 107, 47, 1

[56] References Cited

U.S. PATENT DOCUMENTS

| | | | |
|---|---|---|---|
| 4,075,829 | 2/1978 | Goff | 58/74 X |
| 4,078,376 | 3/1978 | Freeman | 58/74 X |

*Primary Examiner*—Ulysses Weldon
*Attorney, Agent, or Firm*—Kurt Kelman

[57] ABSTRACT

A system for measuring and indicating the time required for a movement from a first location to a second location that is spaced from the first location, including a first transmitter located at the first location and adapted to transmit either an RF or an acoustical signal, a second transmitter located at the second location and then adapted to transmit a second acoustical or RF energy signal, a moving vehicle, such as a sports implement, designed to travel between the first and second locations and having a receiver with a sensing antenna, for receiving the first and second acoustical or RF energy signals. The receiver is connected by a start-switch and a stop-switch to an electronic stopwatch which is capable of delivering timed clock signals to a memory circuit. An electronic read-out display, such as a liquid crystal display, is connected to the memory circuit, so that as the vehicle travels past the first transmitter, the start-switch connected to the receiver will turn on the stopwatch to begin a count of the pulse train and, as the vehicle passes the second transmitter, the stop-switch will turn off the stopwatch and the display will provide the elapsed time for the movement between the first and second locations.

7 Claims, 4 Drawing Figures

Figure 1:
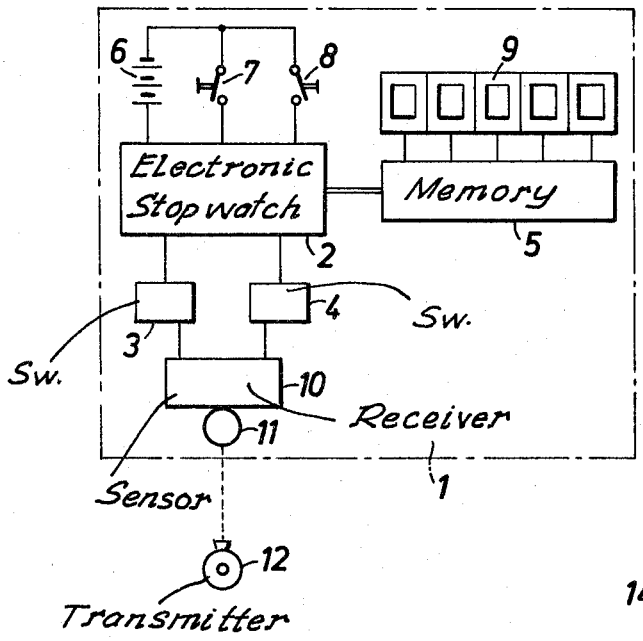

DEVICE FOR MEASURING AND INDICATING THE TIME BETWEEN THE RECEPTION OF FIRST AND SECOND AIRBORNE SIGNALS

This invention relates to a time-measuring and -indicating device comprising an electronic stop watch and associated start and stop switches as well as a memory and display means for determining and indicating the time required by a moving object to move over a course having a selected finite length, which device is mounted on the moving object, such as a sports implement.

Known time-measuring and -indicating devices comprising electronic watches can be mounted on a moving object if the time is to be ascertained which is required by said object to move over a course of finite length. Such stop watches are manually triggered by an operator. If a plurality of objects move over a plurality of objects provided with such time-measuring device, the device cannot be started and stopped exactly at the same time and in a reproducible manner and the times thus ascertained cannot be exactly compared. The same disadvantages arise when the same object is to move over the course several times in succession.

It is known to eliminate these disadvantages by the use of a time-measuring device which is stationary or in any case is separate from the moving object and is triggered by remote control. Such devices are triggered when the moving object passes through the starting point and the final point of the course. That practice has the disadvantage that when the moving object is constituted, e.g., by an athlete the time which has been ascertained must be indicated to the athlete by additional transmitting means carried by him. So much time and personnel are required to set up said system that the same can be used only for public events.

It is an object of the invention to provide an automatic time-measuring and -indicating device which is inconspicuous and can be used with a minimum of expenditure and indicates the time which has been measured to the user as directly as possible.

In a time-measuring and -indicating device of the kind described first hereinbefore that object is accomplished according to the invention in that the start and stop switches are connected to a sensor, which is actuable by remote control by means of stationary transmitters, which are positioned at the ends of the course, and that in response to the reception of a first signal from a first transmitter the start switch connects the electronic stop watch to the memory and/or the display means, and in response to the reception of a second signal from a second transmitter the stop switch element interrupts the first-mentioned connection and connects the memory to the display means.

The invention thus provides an arrangement in which the stopped time can be read by the user, such as a skier, or at the moving object itself, immediately when the finishing line has been reached. This is accomplished in a surprisingly simple and advantageous manner. No transmission lines are required for that purpose and the two signal transmitters can be installed inconspicuously. Besides, that device for measuring time can be manufactured at low cost as an absolutely shockproof modular assembly, which is reliable in operation. As a result, particularly athletes training for themselves in preparation for a competition can optimize their motions over longer and even over extremely short distances, as is desirable mainly in cycling, riding, track-and-field athletics, bobsledding, motoring and particularly skiing.

According to an additional feature of the invention the sensor, the start and stop switches, the electronic stop watch, the memory and the display means are accommodated in a hermetically sealed housing, which is fixed to a sports implement, such as a ski. In this way, a definite relation is established to the transmitters and cannot be adversely affected by the motion of the athlete.

According to another feature of the invention the transmitters comprise active (signal-generating) or passive (signal-modifying) transmitters for transmitting acoustic or electromagnetic waves or radiant energy signals, or magnetic or metal tapes because this ensures a particularly inconspicuous triggering of the several control functions.

Finally it is within the scope of the invention to accommodate each transmitter together with associated power supply means in a liquid-tight housing, which is preferably provided with holding means that are adapted to be driven into the soil. That feature will facilitate the definition of the limits of the course and will minimize the expenditure.

To facilitate the understanding of the invention an embodiment thereof will now be explained more fully and by way of example with reference to the drawings, in which FIG. 1 is a block circuit diagram of an embodiment of the time-measuring and -indicating device according to the invention.

Figure 2:
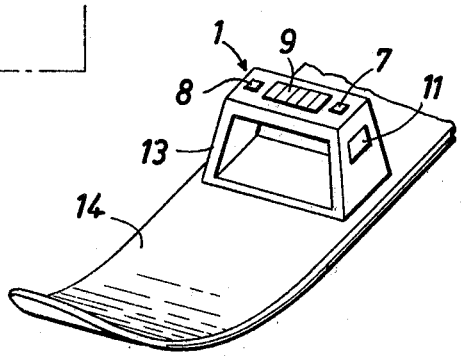
Figure 3:
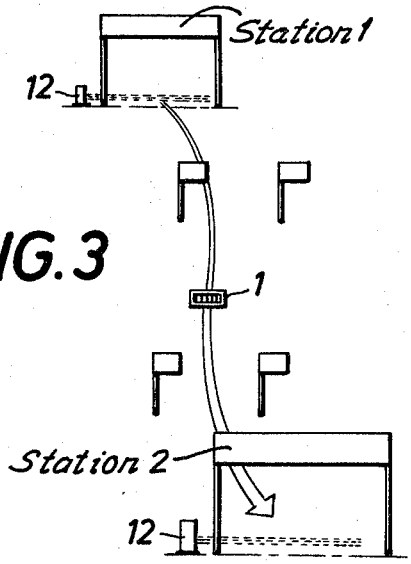
Figure 4:
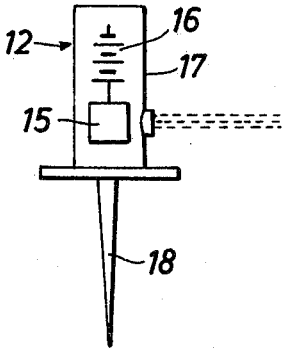

FIG. 2 shows the arrangement of that time-measuring and -indicating device on a ski, FIG. 3 shows diagrammatically a path of finite length and a time-measuring and -indicating device with the associated transmitter and FIG. 4 is an enlarged side elevation showing the transmitter.

The time-measuring and -indicating device 1 shown in FIG. 1 comprises an electronic stop watch 2, which is preferably monolithically integrated, start and stop switches 3, 4, and a memory 5. There are also a power supply element 6, a master switch 7, and a resetting key 8, which is connected to the electronic stop watch 2. The memory 5 is coupled to 4-, 5- or 6-digit display means 9, which comprise a liquid crystal or gas display. Each of the start and stop switches 3 and 4 is connected by a lead to a receiver 10, which is responsive to acoustic sound or electromagnetic waves and belongs to a sensor 11. A transmitter 12 for sound or radiant energy signals, such as electromagnetic waves is associated with the sensor.

It is apparent from FIG. 2 that the time-measuring and -indicating device 1 is accommodated in a hermetically tight housing 13, which is fixed to the scoop of a ski 14. The display means 9, the master switch 7 and the resetting key 8 are provided on the top of the housing 13. A receiver 10 of the sensor 11 is disposed near each longitudinal side of the ski.

The mode of operation of the device according to the invention will now be explained more fully with reference to the diagrammatic FIG. 3, which shows two transmitters 12 located at the start and finishing line of a slalom course, respectively. The time-measuring and -indicating device 1 moves along said course. As the receiver 10 mounted on the ski 14 moves past the transmitter 12 at the start, the receiver 10 responds to cause the start switch 3 to transmit the clock pulses from the electronic stop watch 2 to the memory 5. When the receiver 10 moves past the transmitter 12 at the finishing line, the stop switch 4 interrupts the connection between the stop watch 2 and the memory 5 and causes the measured time to be indicated by the display means 9.

When the user has read the time, he actuates the resetting key 8 to restore the device to its initial condition. The entire device can be de-energized by the master switch 7.

FIG. 4 shows a transmitter unit 12 comprising an active or passive transmitter 15 for transmitting acoustic or electromagnetic waves and a power supply 16. Transmitter unit 12 could also be a magnetic tape. The parts 15 and 16 are accommodated in a liquid-tight housing 17, which is provided with means 18 for fixing the unit to the soil.

What is claimed is:

1. A system mounted on a vehicle for measuring and indicating the time required for a movement from a first location to a second location spaced from the first location, said system comprising:

a first transmitter located at said first location and adapted to transmit a first energy signal;

a second transmitter located at said second location and adapted to transmit a second energy signal;

an electronic stopwatch for delivering clock signals;

a memory coupled to said watch for receiving and storing said clock signals;

display means coupled to said memory means for providing a visual indication of the clock signals stored by said memory;

an energy signal receiver having a sensor for receiving said first and second energy signals;

a start switch for coupling the output of said receiver to the input of said stopwatch and responsive to said first energy signal, so as to turn on said watch to provide clock signals; and a stop switch for coupling the output of said receiver to the input of said stopwatch and responsive to said second energy signal, so as to turn off said watch and terminate the clock signals.

2. The system as recited in claim 1, wherein said vehicle comprises sports implement.

3. The system as recited in claim 2, wherein said sports implement comprises a ski.

4. The system as recited in claim 1, wherein said first and second transmitters are adapted to transmit their energy signals as acoustical sound waves, and wherein said receiver is an acoustical signal receiver.

5. The system as recited in claim 1, wherein each of said transmitters transmits radiant energy signals and said receiver is a radiant energy receiver.

6. The system as recited in claim 2, wherein said stopwatch, memory, display means, receiver and start and stop switches, are sealed to said vehicle.

7. The system as recited in claim 1, additionally comprising a master switch for turning on said electronic stopwatch and a reset key for resetting the stopwatch and the memory containing the clock signals.

* * * * *